United States Patent [19]

Rising

[11] 4,323,230

[45] Apr. 6, 1982

[54] MACHINE FOR SEPARATING BILLS AND COUPONS

[75] Inventor: Robert P. Rising, Trumbull, Conn.

[73] Assignee: The Perkin-Elmer Corporation, Norwalk, Conn.

[21] Appl. No.: 102,184

[22] Filed: Dec. 10, 1979

[51] Int. Cl.[3] ..... B65H 3/08

[52] U.S. Cl. ..... 271/12; 271/30 A; 271/94; 271/121; 271/150; 271/155

[58] Field of Search ..... 271/12, 30 A, 121, 124, 271/150, 155, 94

[56] References Cited

U.S. PATENT DOCUMENTS

| | | | |
|---|---|---|---|
| 2,161,124 | 6/1939 | Babicz | 271/149 |
| 3,226,109 | 12/1965 | Thompson | 271/150 X |
| 3,258,262 | 6/1966 | Rehm | 271/94 |
| 3,537,361 | 11/1970 | Derderian | 271/149 X |
| 3,907,283 | 9/1975 | Miller | 271/258 |
| 3,976,291 | 8/1976 | Bernardi | 271/30 A |

*Primary Examiner*—Richard A. Schacher

*Attorney, Agent, or Firm*—Salvatore A. Giarratana; E. T. Grimes; T. P. Murphy

[57] ABSTRACT

A rotatable drum switches a vacuum source on and off towards an outermost bill in a stack to separate bills one at a time at high speeds from the stack and provide registration between the separate bills. As the bills are separated from the stack, means are provided to maintain a relatively constant pressure on the stack of bills. Flexible bands transport the separated bills away from the stack.

13 Claims, 6 Drawing Figures

10
12
14
16
17
18
19
20
21
22
24
25
26
27
28
30
32
36
38
46
50
52
61
66
68
78
80
94
101
102
103
2
3
4
5
100
200
300
400
500
600
700
800
900
1000

FIG. 3
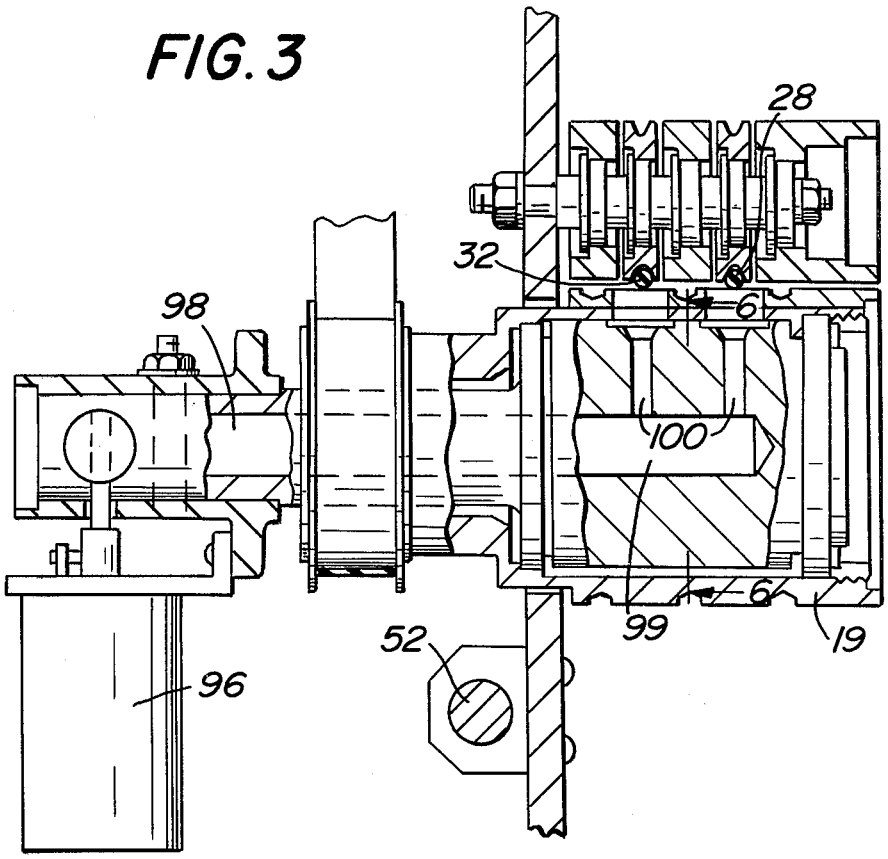
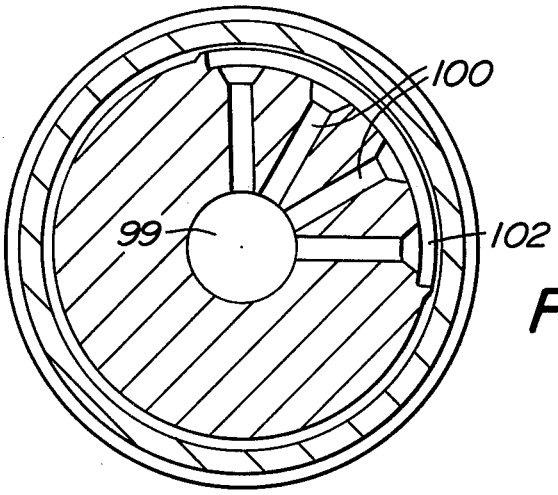
FIG. 6

MACHINE FOR SEPARATING BILLS AND COUPONS

BACKGROUND OF INVENTION

Various types of machines have been provided in the past to separate or "single" bills from a stack. The separator or singler may be used for counting or other purposes. In some cases involving worn monetary bills, separators are used to separate or bills so that they can be passed on to a shredding machine, where the bills must be fed individually to assure efficient shredding. Whether used for counting or for shredding, the spacing or registration between the separated bills is often important. Registration assures that there is adequate and predetermined spacings between the separated bills so the separated bills may be related to subsequent machine operations.

When a large number of bills are involved, the separation of the bills must take place at relatively high speeds. This is necessary to minimize the amount of time and manual labor required and provide overall efficiency in the system with which the separating machine is employed.

The high speed machine must be capable of separating bills or coupons one at a time from a stack with accurate registration even when different types of bills or coupons are involved. For example, the normal monetary bills from a stack may range from raggedy, ripped bills to newer relatively stiff bills. Any machine using separating means to separate these types of bills must separate equally each of the bills, whether new or old.

In order to provide an efficient machine for separating bills and coupons, it is generally necessary to provide a constant pressure against the stack of bills as the individual bills are removed. If a constant pressure is not applied, more than a single bill may be removed or in some cases no bills at all will be removed.

While references to bills and coupons will be made throughout the specification, these are merely convenient terms and are also applicable to flexible items, generally paper, which may not normally be referred to as bills or coupons.

OBJECTS OF INVENTION

It is an object of this invention to provide improved apparatus for separating bills one at a time from a stack of bills at relatively high speeds.

It is a further object of this invention to provide an improved machine for singling bills one at a time from a stack with accurate registration between the bills.

It is still a further object of this invention to provide an improved machine for separating bills from a stack where the bills in the stack range from raggedy, ripped bills to newer ones.

It is still a further object of this invention to provide a machine for separating bills from a stack one at a time with improved means of controlling the pressure against the stack as the bills are removed.

BRIEF SUMMARY OF INVENTION

In accordance with the present invention, means are provided to stack bills or coupons which are to be separated or singled one at a time. A rotatable drum switches a source of vacuum on and off to remove an outermost bill from the stack and pass it on to a pair of movable bands with registration being provided between the separated bills. The bills are removed from the stack at relatively high speed and, because of this, means including a movable carriage are provided to produce a constant force on the stack of bills as the individual bills are separated.

Other objects and advantages of the present invention will be apparent and suggest themselves to those skilled in the art, from a reading of the following specification and claims, taken in conjunction with the accompanying drawings.

DESCRIPTION OF THE DRAWINGS

FIG. 3 is a cross-sectional view taken along lines 3—3 of FIG. 1;

FIG. 6 is a cross-sectional view taken along lines 6—6 of FIG. 3.

DESCRIPTION OF INVENTION

Figure 1:
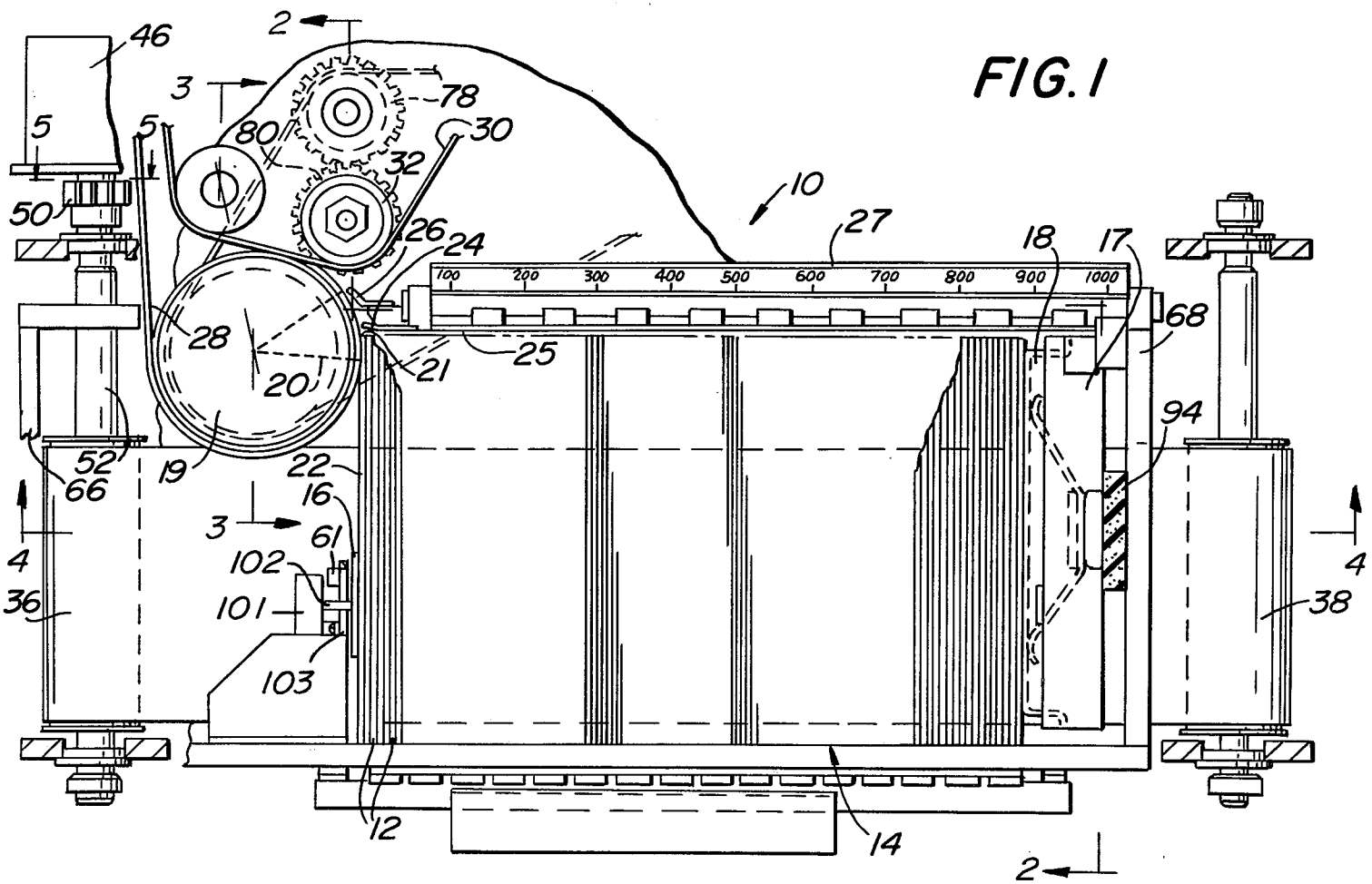
FIG. 1 is a plan view of a bill separating machine, partly in cross-section, in accordance with the present invention.
Figures 4, 5:
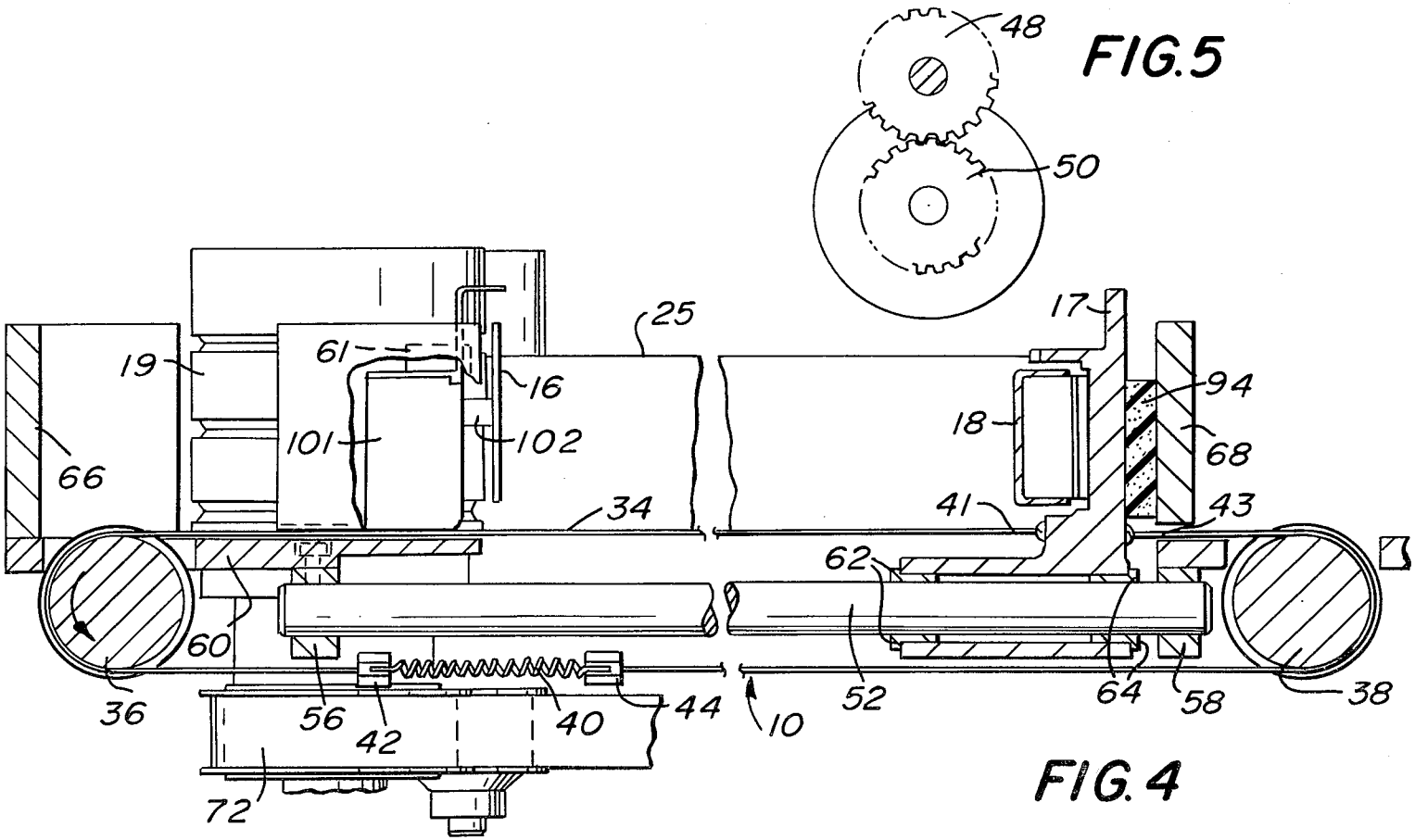
FIG. 4 is a cross-sectional view taken along lines 4—4 of FIG. 1.
FIG. 5 is a view taken along lines 5—5 of FIG. 1.

Referring particularly to FIGS. 1 and 4, a separating machine or singler 10 is adapted to receive a plurality of bills or coupons 12 which are to be singled or separated from the stack 14. The bills 12 are disposed between an end plate or stop member 16 and a pressure plate 18. The pressure plate 18 is secured to a movable carriage 17. The length of the end plate 16 is shorter than the bills and is such so as to balance the force on the bills and allow close to zero force at the free ends of the bills.

The stack 14 rests on a movable belt 34, which may be moved in steps to move the carriage 17 as bills are separated at high speeds, as will be described. A support member 25 supports a flexible retarding guard 24 which contacts the drum 19 and a guide plate 26. Indictia 27 is provided for indicating the approximate number of bills in the stack.

A vacuum drum 19, which will be subsequently described in detail, is rotatable and includes vacuum ports about an angular portion of its periphery illustrated by dotted lines 20. The vacuum ports disposed between the dotted lines 20 are positioned with respect to the drum so that it is approximately 1/32 of an inch from the outermost bill 22 of the stack 14. When the drum 19 is rotated counterclockwise, a low pressure or vacuum is switched on and off. The outermost bill 22 is attracted to the drum 19 when the vacuum ports pass adjacent thereto, with no vacuum being applied for the rest of the drum rotation thereby providing space or registration between the bills as they are removed from the stack.

As a result of the rotation of the drum 19, its vacuum ports (more clearly illustrated in FIG. 6) come in line with the top edge 21 of the bill 22. The vacuum is turned on and the bill 22 is pulled tightly against the drum 19 and transported away from the stack 14. After the bill 22 is pulled away from the stack, it is moved past the flexible retarding guard 24 which flexes to permit the bill which has been removed from the stack to pass through the guide plate 26.

Figure 2:
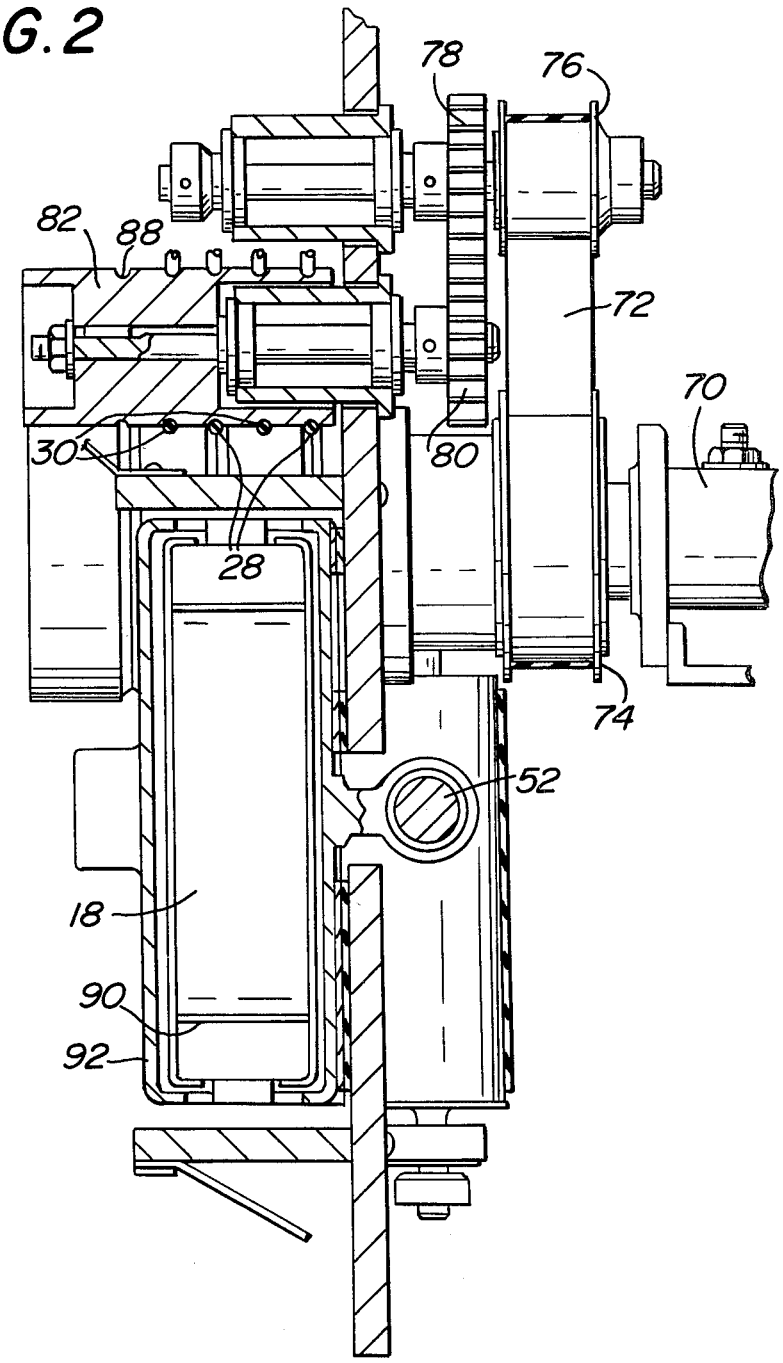
FIG. 2 is a cross-sectional view taken along lines 2—2 of FIG. 1.

After the separated bill passes the guide plate 26, it is gripped by one or more pairs of flexible bands or transports 28 and 30, which are driven by suitable means to be described. The band or bands 28, which may be rubber, are disposed around the vacuum drum 19. The band or bands 30, which may also be made of rubber, are driven by a pulley element 32. In a preferred embodiment as illustrated in FIG. 2, a plurality of bands 28 and 30 are spaced with respect to each other and generally in the same line. The relatively narrow bands make it possible to grip bills or coupons of different types, such as the relatively old, ragged ones and relatively new stiff bills. The narrow transport bands provide relatively narrow contact with the bills making it easier for the bands or belts 28 and 30 to positively grip the separated bills.

After the angular portion 20 of the drum 19, which includes the vacuum ports, has passed out of proximity to the stack of bills, the vacuum is, in effect, turned off. The turning off of the vacuum prevents any additional bills from being attracted to the drum 19 to be separated from the stack 14. No additional bills are separated from the stack until the vacuum drum 19 makes a complete revolution and the vacuum ports again pass in proximity to the outermost bill 22. Because of the constant speed of the drum 19, the times at which the vacuum is applied or not applied permits the registration or spacing between the separated bills to be consistent. This accuracy is important for the subsequent operations relating to the bills after separation, such operations not being described or shown because they are not related to the present invention.

As mentioned the plate or stop 16 is such that its size balances the force of the bills 12 but allows close to zero force between the free ends or top edges of the bills. The close to zero force between the bills is required for newer bills which have high interbill friction. The force exerted against the stack 14 may be approximately 30 grams. It is important that this force be maintained relatively constant as bills are separated from the stack and the stack becomes progressively smaller. Too high a force prevents the bills from slipping past each other. Too low a force will prevent the outermost bill from being separated as a result of not being close enough to the vacuum path of the drum.

As illustrated in FIG. 4, the belt 34 is disposed on pair of drums 36 and 38. Free ends of the belt 34 are connected together by means of a spring 40 connected to suitable clamps 42 and 44 secured to the belt. More than one spring may be used although only one is illustrated. Other ends 41 and 43 of the belt 34 are secured by suitable means on opposite sides of the carriage 17. As illustrated in FIGS. 1 and 5, a motor 46 is connected to suitable gears 48 and 50. Operation of the gear 50 drives the shaft 52 which in turn drives the drum 36.

A pressure switch 101 is connected to end plate 16 via arm 102. The pressure switch 101 is mounted on support plate 103 which in turn is fixed to housing 60 in any convenient manner. The pressure switch 101 is connected in the power supply circuit to motor 46. The pressure switch 101 is activated on to connect power to motor 46 when sensed pressure on arm 102 via end plate 16 falls below a predetermined amount. Power is disconnected from motor 46 when pressure via end plate 16 on arm 102 is above the predetermined valve. Thus, motor 46 turns on when pressure of the stack 14 against end plate 16 falls below the predetermined amount to cause carriage assembly 17 to move pressure plate 18 toward end plate 16. Motor 46 is turned off when pressure on the end plate 16 is above the predetermined amount. Thus, as the bills become depleted motor 46 is continuously turned on and off thereby maintaining a relatively constant pressure against the stack of bills. The spring means including the spring 40 maintains the belt 34 under tension and assists in maintaining the constant pressure by absorbing abrupt movements when the motor 46 is turned on.

In the present embodiment as many as fifteen bills per second may be removed from the stack. The maintenance of constant tension on the stack assures that the outermost bill to be removed, such as the bill 22 in FIG. 1, is being subjected to a relatively constant pressure so as to permit it to be removed by the vacuum formed by the vacuum drum 19.

As the bills are depleted, the carriage assembly 17 rides along a shaft 52 closer to the plate 16. The shaft 52 is secured to shaft hangers 56 and 58. The shaft hangers 56 and 58 are suitably mounted to the bottom portion of the housing 60. As the bills tend to become depleted, motor 46, as aforesaid, by intermittent rotation of the durm 36 causes the pressure plate 18 to move forward along with the carriage assembly 17 at a relatively constant pressure against the stack of bills. A detector 61, which may be a photoelectric cell, a pressure sensor or other suitable means, detects the absence of bills when all the bills in the stack have been removed.

The carriage assembly 17 is mounted to the shaft 52 to suitable bushings 62 and 64. The housing for the machine 10 also includes end plates 66 and 68 which are secured to the bottom portion 60 with the plate 66 having a suitable opening therein to permit the belt 34 to pass therethrough.

Referring to FIGS. 2 and 3, along with FIGS. 1 and 4, various details relating to the driving mechanisms are illustrated. As illustrated in FIG. 2, a motor 70 is connected to drive a pully belt 72. The pully belt 72 is connected between pully wheels 74 and 76. The pulley wheel 76 is connected to a suitable shaft to drive a pair of intermeshing gears 78 and 80. These gears are also illustrated in FIG. 1. The gear 80 is connected to a roller 82 which includes a plurality of recesses 88 therein to receive the rubber bands or transmission elements 28 and 30. The vacuum drum 19 also includes recesses 89 to receive the rubber band elements 28 and 30. When the outermost bill 22 (FIG. 1) is removed from the stack 14 by the application of vacuum from the drum 19, it is gripped and passes between the bands 28 and 30.

Still referring to FIG. 2, the pressure plate 18 is illustrated with a portion of a spring 90 within a casing 92. As also illustrated in FIG. 1, the pressure plate 18 is backed by a cushion 94.

Means for providing the vacuum to the vacuum ports of the rotating drum 19 is illustrated in FIGS. 3 and 6. A vacuum source 96 is connected to suitable openings 98 to an area 99 inside the vacuum drum 19. The vacuum drum 19 includes a plurality of radially extending openings 100 leading from the area 99 to the periphery of the drum 19. As the drum is rotated in a counterclockwise direction by the various gearing mechanisms and motor 70 illustrated in FIG. 2, the openings 100 come in close proximity with the edge 21 of the bill 22 to be removed. After the area of the openings 100 has passed the stack of bills, no vacuum is applied to the exterior of the drum 19 and no bills will be removed from the stack 14. The drum may include a rubber guard 102 which assists in gripping the separated bill.

It is seen that the present invention has provided a separator or singler machine which is capable of operating at very high speeds and in which the registration between the separated bills is maintained accurate. In addition, the pressure on the stack is relatively constant as the bills are separated.

What is claimed is:

1. Apparatus for separating at high speeds one at a time bills and the like from a stack comprising:

means for holding a stack of bills including a first end element disposed to contact a portion of the outermost bill to be separated from said stack with the remaining portion having an exposed top portion allowing substantially zero force between the bills in said top portion of said stack to permit the application of a force thereto and a second end element disposed against the innermost bill of said stack and movable relative to said first end element, means for maintaining said stack under low pressure as bills are removed therefrom including first and second pulleys, a belt disposed about said first and second pulleys, said belt having a first set of ends secured to opposite sides of said second element, and a second set of ends, spring means securing said second set of ends to each other, a source of electrical power, a pressure sensitive switch mechanically connected to said first end element actuated on when pressure exerted by said first end element falls below a predetermined amount and off when pressure exerted by said first end element rises above said predetermined amount, motor means, said pressure sensitive switch electrically connected between said motor means and said source of electrical power for moving said second end element toward said first end element until said pressure sensitive switch is turned off, means for applying a force only to said exposed portion of said outermost bill to separate it from said stack, and means for transporting the separated bill away from said stack.

2. Apparatus as set forth in claim 1 wherein said means for applying a force comprises a rotatable drum connected to a source of vacuum and being disposed to have its periphery in close proximity to an edge of the exposed portion of said outermost bill.

3. Apparatus as set forth in claim 2 wherein said rotatable drum includes vacuum ports connected from said source of vacuum to an angular area of the periphery of said drum whereby the vacuum pressure applied to said outermost bill is turned on and off as said drum is rotated.

4. Apparatus as set forth in claim 3 wherein the vacuum pressure applied to said outermost bill when said angular area of said drum is in close proximity thereto causes said outermost bill to be attracted to said drum and be removed from said stack by said drum with no bills being removed when no vacuum is applied to said outermost bill thereby providing registration between the removed bills from said stack.

5. Apparatus as set forth in claim 4 wherein a high friction material is disposed on said angular area on the periphery of said drum.

6. Apparatus as set forth in claim 5 wherein said means for maintaining said stack under pressure further comprises a belt for supporting said stack of bills.

7. Apparatus as set forth in claim 6 wherein said means for transporting comprises a first movable band on said rotatable drum and a second movable band disposed to coact with said first movable band to receive said outermost bill removed from said stack by said drum and transport it away from said drum.

8. Apparatus as set forth in claim 7 wherein said first and second movable bands are disposed over the area of separation of said outermost bill and disposed to grip the removed outermost bill on opposite surfaces thereof.

9. Apparatus as set forth in claim 8 wherein a plurality of relatively narrow said movable bands are provided to grip said separated outermost bill.

10. Apparatus as set forth in claim 9 wherein said plurality of narrow bands comprises flexible high friction material disposed in the same plane at the area at which said separated outermost bill is gripped and transported.

11. Apparatus as set forth in claim 10 including a support member, a flexible strip extending from said support member to engage said rotatable drum to retard bills other than said separated outermost bill from being removed from said stack and to provide accurate registration between the bills removed from said stack.

12. Apparatus as set forth in claim 11 wherein a guide element extends from said support member to guide said separated outermost bill to said means for transporting after it has passed said flexible strip.

13. Apparatus as set forth in claim 12 wherein detector means are provided to detect the absence of bills after removal of all the bills from the stack.

* * * * *